US010167166B2

(12) United States Patent
Kakitani

(10) Patent No.: US 10,167,166 B2
(45) Date of Patent: Jan. 1, 2019

(54) IMAGE FORMING APPARATUS

(71) Applicant: CANON KABUSHIKI KAISHA, Tokyo (JP)

(72) Inventor: Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/641,606

(22) Filed: Jul. 5, 2017

(65) Prior Publication Data

US 2018/0009625 A1 Jan. 11, 2018

(30) Foreign Application Priority Data

Jul. 8, 2016 (JP) ..... 2016-136078

(51) Int. Cl.

| | |
|---|---|
| ***B65H 7/06*** | (2006.01) |
| ***B65H 43/04*** | (2006.01) |
| ***G03G 15/00*** | (2006.01) |
| ***G03G 21/16*** | (2006.01) |

(52) U.S. Cl.

CPC ..... *B65H 43/04* (2013.01); *B65H 7/06* (2013.01); *G03G 15/5016* (2013.01); *B65H 2402/45* (2013.01); *B65H 2511/417* (2013.01); *B65H 2511/528* (2013.01); *B65H 2551/20* (2013.01); *B65H 2551/23* (2013.01); *B65H 2551/29* (2013.01); *B65H 2557/65* (2013.01); *B65H 2601/11* (2013.01); *G03G 21/1633* (2013.01); *G03G 21/1638* (2013.01); *G03G 2221/1654* (2013.01)

(58) Field of Classification Search

CPC ..... B65H 7/06; B65H 43/04; B65H 2551/23; B65H 2551/29; B65H 2557/65; B65H 2511/417; B65H 2601/11

See application file for complete search history.

(56) References Cited

U.S. PATENT DOCUMENTS

| | | | | |
|---|---|---|---|---|
| 5,157,448 | A * | 10/1992 | Lang | G03G 15/6502 271/157 |
| 7,403,721 | B2 * | 7/2008 | Yamada | G03G 15/70 399/16 |
| 8,608,154 | B2 * | 12/2013 | Yamada | G03G 15/6502 271/164 |
| 8,770,577 | B2 * | 7/2014 | Onodera | B65H 3/44 109/73 |
| 9,533,846 | B2 * | 1/2017 | Ishii | B65H 1/266 |
| 9,561,920 | B1 * | 2/2017 | Wilsher | B65H 1/266 |

(Continued)

FOREIGN PATENT DOCUMENTS

| | | | |
|---|---|---|---|
| JP | 05-289446 | A | 11/1993 |
| JP | 2012-194202 | A | 10/2012 |

*Primary Examiner* — Patrick Cicchino

(74) *Attorney, Agent, or Firm* — Venable LLP

(57) ABSTRACT

An image forming apparatus forming an image on a sheet, including: an exterior member movable with respect to an apparatus main body; a locking portion locking the exterior member to the apparatus main body such that the exterior member is not moved with respect to the apparatus main body; a display portion which is disposed on the exterior member and displays a state of the locking portion; and a light source turning on the display portion, in which the display portion includes a thin portion which is a part of the exterior member, has a thickness less than thicknesses of other portions of the exterior member, and transmits light from the light source.

23 Claims, 10 Drawing Sheets

(56) References Cited

U.S. PATENT DOCUMENTS

| | | | | |
|---|---|---|---|---|
| 2014/0167580 | A1* | 6/2014 | Funayama | E05B 47/0012 312/237 |
| 2014/0167587 | A1* | 6/2014 | Takenaka | G03G 21/1647 312/333 |
| 2014/0169828 | A1* | 6/2014 | Ohta | G03G 15/6502 399/110 |

* cited by examiner

IMAGE FORMING APPARATUS

BACKGROUND OF THE INVENTION

Field of the Invention

The present invention relates to an image forming apparatus forming an image on a sheet.

Description of the Related Art

In an image forming apparatus which is generally known from the related art, an operation is performed in which a toner image is transferred onto a sheet, such as a recording paper, fed from a cassette in a transfer portion, the toner image is fixed in a fixing portion, and after that, the sheet is discharged to the outside of the apparatus.

In the image forming apparatus described above, the sheet is accumulated in the apparatus (hereinafter, referred to as a jam) while the sheet is conveyed, due to overlap feeding, a conveying error, or the like of the sheet, and thus, there is a case where the sheet is not normally discharged to the outside of the apparatus, and remains in the apparatus. In this case, an LED light emitting portion is provided in a door or a conveying guide as a unit informing a user of the situation of the apparatus and of where to access (Japanese Patent Laid-Open No. 2012-194202).

In Japanese Patent Laid-Open No. H5-289446, a display portion displaying the effect that a door is in a lock state is provided in the door.

The display portion is formed of a material which is generally different from that of an exterior member, and thus, a manufacturing cost such as an assembly cost or a component cost occurs.

SUMMARY OF THE INVENTION

According to the present invention, an image forming apparatus forming an image on a sheet includes: an exterior member movable with respect to an apparatus main body; a locking portion which locks the exterior member to the apparatus main body such that the exterior member is not moved with respect to the apparatus main body; a display portion which is disposed on the exterior member and displays a state of the locking portion; and a light source which turns on the display portion, wherein the display portion includes a thin portion which is a part of the exterior member, has a thickness less than thicknesses of other portions of the exterior member, and transmits light from the light source.

Further features of the present invention will become apparent from the following description of exemplary embodiments with reference to the attached drawings.

DESCRIPTION OF THE EMBODIMENTS

Hereinafter, embodiments of the invention will be described in detail with reference to the drawings as an example. Here, the dimension, the material, the shape, the relative arrangement, or the like of the constituents in the following embodiments can be suitably changed according to the configuration of an apparatus to which the invention is applied or various conditions, but the range of the invention is not limited thereto.

<Image Forming Apparatus>

Figure 2:
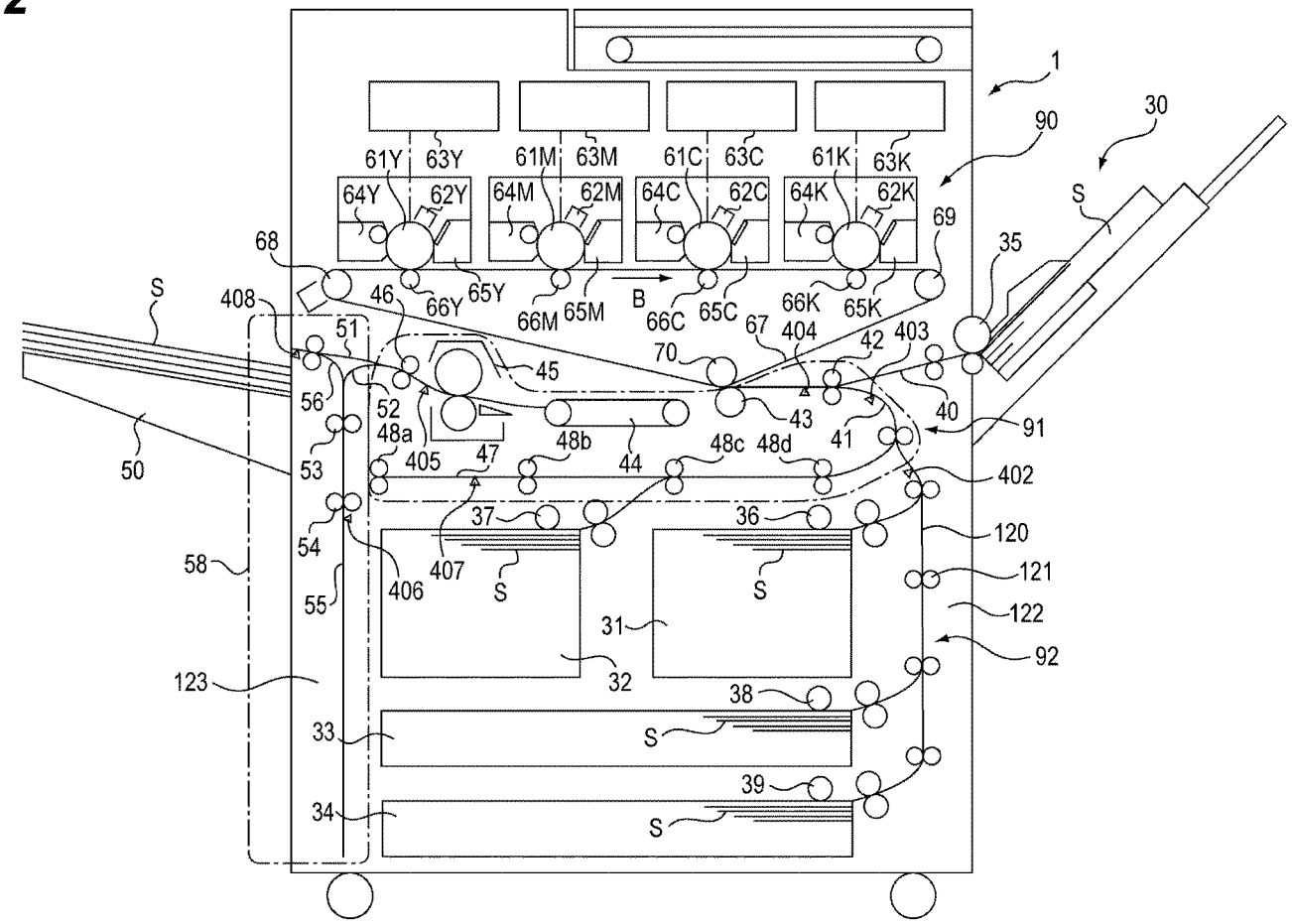
FIG. 2 is a schematic sectional view of a schematic configuration of an image forming apparatus.

FIG. 2 is a schematic sectional view of an image forming apparatus, which is an example of the embodiment of the invention. The image forming apparatus according to this embodiment is a color image forming apparatus using an electrophotographic system. Here, an image forming apparatus adopting an intermediate transfer tandem manner is exemplified in which image forming units of four colors are arranged on an upper portion of an intermediate transfer belt side by side, from an advantage of adjustability or print productivity with respect to various sheets.

An image forming apparatus 1 includes a sheet feeding portion 92 and a multi-feeding portion 30 feeding a sheet, and a sheet conveying apparatus 91 conveying the sheet fed by the sheet feeding portion 92 or the multi-feeding portion 30. Then, the image forming apparatus 1 includes an image forming portion 90 forming an image on the sheet conveyed by the sheet conveying apparatus 91.

<Image Forming Portion 90>

The image forming portion 90 includes a photoreceptor 61 (61Y, 61M, 61C, and 61K), a charging unit 62 (62Y, 62M, 62C, and 62K), an exposure unit 63 (63Y, 63M, 63C, and 63K), and a developing unit 64 (64Y, 64M, 64C, and 64K). In addition, the image forming portion 90 includes a primary transfer unit 66 (66Y, 66M, 66C, and 66K) and a photoreceptor cleaner 65 (65Y, 65M, 65C, and 65K).

The image forming portion 90 includes an intermediate transfer belt 67 onto which the toner image formed on the photoreceptor 61 (61Y, 61M, 61C, and 61K) is primarily transferred, and a transfer roller 43 for transferring a full color toner image, which is transferred onto the intermediate transfer belt 67 in a superimposed manner, onto the sheet. The intermediate transfer belt 67 is conveyed and driven by being stretched by a roller such as a driving roller 68, a tension roller 69, and a secondary transfer inner roller 70.

<Sheet Feeding Portion>

The sheet feeding portion 92 includes sheet containers 30 to 34, sheet feeding units 35 to 39, and a vertical conveying path 120 through which the sheet, which is fed by the sheet feeding units 35 to 39 and directed towards the sheet conveying apparatus 91, passes. A conveying roller 121 conveying the sheet is disposed on the vertical conveying path 120. The vertical conveying path 120 (a second conveying path) is opened by rotating a right door 122 which is disposed on a right side in the view from a front side of the image forming apparatus 1.

<Sheet Conveying Apparatus 91>

The sheet conveying apparatus 91 includes a conveying path 41 (a first conveying path) through which the sheet, which is fed by the sheet feeding units 35 to 39, passes, and a registration roller 42 feeding the sheet to a nip position between the intermediate transfer belt 67 and the transfer roller 43. Further, the sheet conveying apparatus 91 includes a fixing machine 45 fixing the image onto the sheet onto which the toner image is transferred. In addition, the sheet conveying apparatus 91 includes a pre-fixing conveying belt 44 feeding the sheet conveying apparatus 91 includes the sheet onto which the toner image is transferred to the fixing machine 45.

In a case where a front door 93 (refer to FIG. 3B) is opened, the sheet conveying apparatus 91 is capable of being drawn to the front of the image forming apparatus 1.

<Reverse Portion>

A reverse portion 58 switch-back conveying the sheet is provided on the downstream of the sheet conveying apparatus 91 in a sheet conveying direction. A switch-back path 55 through which the sheet, which passes through the discharge conveying path 51, the reverse guide path 52, and the reverse guide path 52, passes is disposed on the reverse portion 58. The reverse portion 58 includes a pair of upper reverse rollers 53 and a pair of lower reverse rollers 54 disposed in the switch-back path 55. Further, a duplex conveying path 47 (a first conveying path) on which the sheet of which a conveying direction is reversed is conveyed is provided on the switch-back path 55 of the reverse portion 58, and is connected to the conveying path 41.

The reverse portion 58 includes a left door 123 which is capable of being opened and closed on a discharge stacking portion 50 side illustrated in FIG. 2. The left door 123 is opened, and thus, the reverse guide path 52 or the switch-back path 55 (a second conveying path) of the reverse portion 58 is opened, and is capable of easily accessing to the accumulated sheet.

In FIG. 2, sensors 402 to 408 respectively represent a sensor group 131 (refer to FIG. 6) sensing the sheet. An operation display portion 202 illustrated in FIG. 3 is a portion for a user to operate various settings with respect to the image forming apparatus 1. The operation display portion 202, for example, displays the user a jam recovery procedure when a jam occurs.

<Sheet Conveying Process>

A sheet S is contained in sheet containers 30 to 34 in the stacked shape, and is fed by each of the sheet feeding units 35 to 39 according to an image forming timing. The sheet S fed by the sheet feeding units 36 to 39 is conveyed to the registration roller 42 through the vertical conveying path 120 and the conveying path 41. The sheet S fed by the sheet feeding unit 35 of the multi-feeding portion 30 is conveyed to the registration roller 42 through the conveying path 40 and the conveying path 41.

The registration roller 42 corrects skew feeding along a front end of the sheet S by forming a loop abutted to the sheet S which is conveyed. In addition, the registration roller 42 conveys the sheet S to a secondary transfer portion at a predetermined timing according to the image forming timing of the sheet S, that is, the toner image borne on the intermediate transfer belt 67, which is an image bearing member. The registration roller 42 feeds the sheet S to the secondary transfer portion at a desired timing, after the skew feeding correction is performed. The secondary transfer portion is a toner image transfer nip portion with respect to the sheet S, which is formed by the secondary transfer inner roller 70 and the transfer roller 43 disposed to face each other. In the secondary transfer portion, the toner image is transferred onto the sheet S by applying a predetermined pressurizing force and an electrostatic load bias.

<Image Formation Process of Image>

An image forming process which is performed at the same period as the sheet conveying process up to the secondary transfer portion will be described.

A latent image is formed on the rotated photoreceptor 61 of which a front surface is evenly charged by the charging unit 62 by driving the exposure unit 63 based on a signal of image information which has been transmitted. An electrostatic latent image formed on the photoreceptor 61 is actualized as a toner image on the photoreceptor 61 through toner development of the developing unit 64. After that, the predetermined pressurizing force and the electrostatic load bias are applied by the primary transfer unit 66, and thus, the toner image on the intermediate transfer belt 67 is transferred from the photoreceptor 61. After that, transfer residual toner remaining on the photoreceptor 61 is collected by the photoreceptor cleaner 65. The transfer residual toner is collected, and then, the photoreceptor 61 is provided for the next image formation again. The image formation described above is performed with respect to each of yellow (Y), magenta (M), cyan (C), and black (K).

A toner image of each of the colors of Y, M, C, and K formed on the photoreceptor 61 is primarily transferred onto the intermediate transfer belt 67, and thus, a toner image of a full color is formed on the intermediate transfer belt 67.

<Process after Secondary Transfer>

In the secondary transfer portion, the toner image of the full color is secondarily transferred onto the sheet. After that, the sheet S is conveyed to the fixing machine 45 by the pre-fixing conveying belt 44. The fixing machine 45 fuses and fixes the toner image onto the sheet S by the predetermined pressurizing force from facing rollers, belts, or the like, or in general, by heat from a heat source such as a heater. A path is selected such that the sheet having a fixed image, obtained as described above is conveyed on the discharge conveying path 51 or on the reverse guide path 52 in a case where reverse discharge or duplex image formation is required, through an inner discharge roller 46.

The sheet conveyed into the discharge conveying path 51 by the inner discharge roller 46 is discharged to the discharge stacking portion 50.

In a case where the duplex image formation is required, the sheet S is drawn into the switch-back path 55 from the reverse guide path 52 through the pair of upper reverse rollers 53 and the pair of lower reverse rollers 54. Front and rear ends of the sheet S are reversed by an operation (a switch-back operation) in which a rotation direction of the pair of lower reverse rollers 54 is inversed on the switch-back path 55, and the sheet S is conveyed to the duplex conveying path 47. After that, the sheet S converges on the conveying path 41 by duplex rollers 48*a* to 48*d* according to a timing of the subsequent sheet conveyed by each of the sheet feeding units 35 to 39, and is fed to the secondary transfer portion through the registration roller 42.

An image forming process with respect to a rear surface (a second surface) of the sheet fed again to the secondary transfer portion is identical to that of a front surface (a first surface) described above, and thus, the detailed description will be omitted.

<Lock Configuration>

Figure 3A:
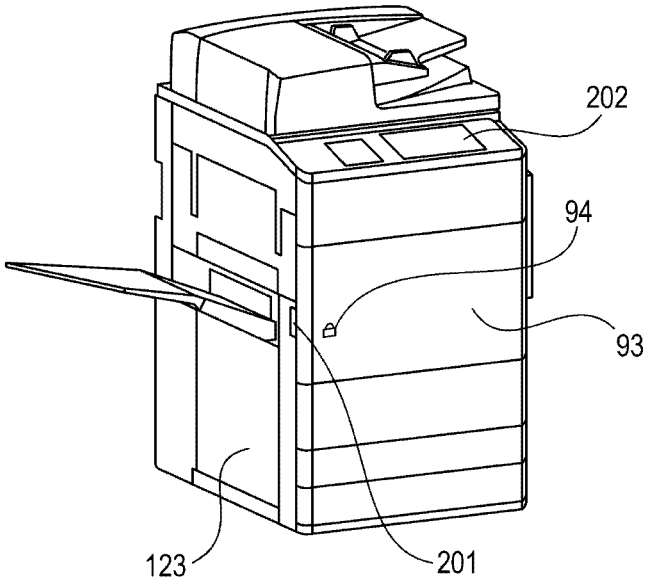
FIG. 3A is an external perspective view of the image forming apparatus.
Figure 3B:
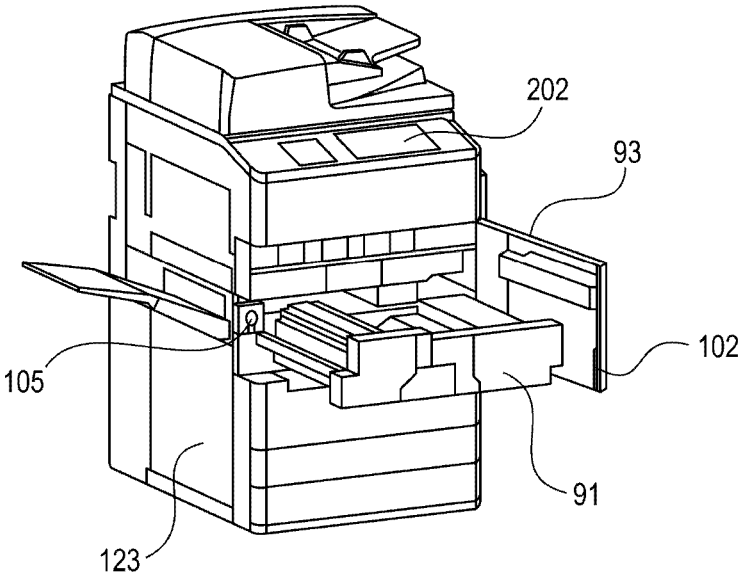
FIG. 3B is a perspective view illustrating a drawing state of a sheet conveying apparatus of the image forming apparatus.

As illustrated in FIG. 3A, the image forming apparatus includes the front door 93 on an apparatus front side. The front door 93 is an exterior member configuring the exterior of the image forming apparatus, and is disposed to be opened and closed with respect to an apparatus main body of the image forming apparatus. As illustrated in FIG. 3B, in a case where the front door 93 is opened, it is possible to access to the inside of the apparatus. Here, in a case where the front door 93 is opened, it is possible to draw the sheet conveying apparatus 91, which can be drawn, to the front of the apparatus from the inside of the apparatus.

Figure 4A:
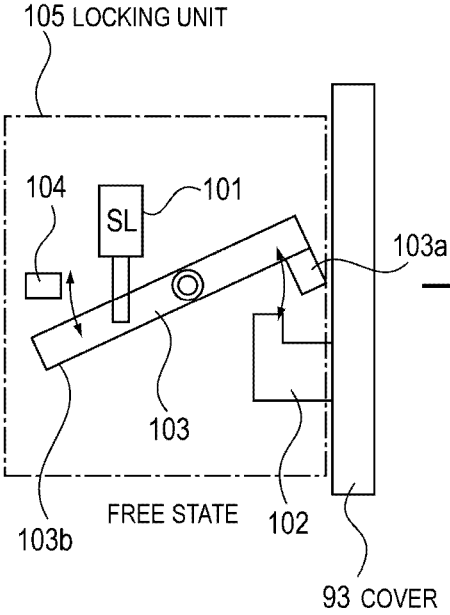
FIG. 4A is a sectional view illustrating a lock releasing state of a locking mechanism.
Figure 4B:
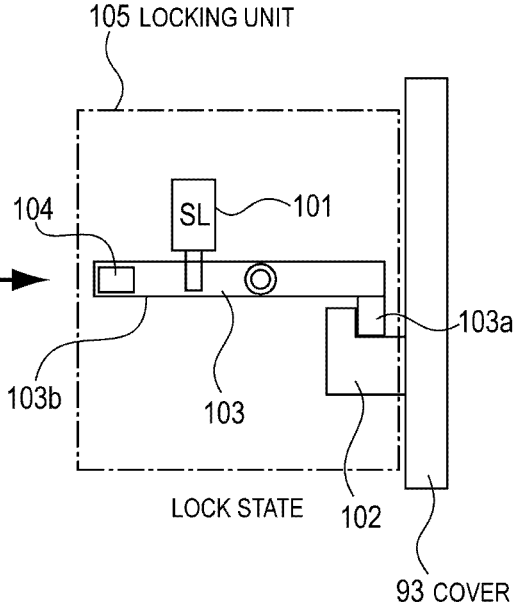
FIG. 4B is a sectional view of a lock state of the locking mechanism.

As illustrated in FIG. 3B, the image forming apparatus includes a locking unit (a locking portion) 105 which locks the front door 93 such that the front door 93 is not opened with respect to the apparatus main body. On the other hand, as illustrated in FIG. 4, the front door 93 includes a hook member 102, which can engage with the locking unit 105, in a position facing the locking unit 105. The locking unit 105 engages with the hook member 102 in a state in which the front door 93 is closed, and thus, the front door 93 is locked such that the front door 93 is not opened with respect to the apparatus main body.

The locking unit 105 includes a locking member 103, which can be rotated to be hooked on the hook member 102, in a position facing the hook member 102 disposed on the front door 93. The locking member 103 includes an engaging portion 103*a* engaging with the hook member 102, and a sensing portion 103*b* on a side of the engaging portion 103*a* opposite to a rotation center side. The lock sensing sensor 104 is a sensing unit sensing the sensing portion 103*b* of the locking member 103. It is sensed whether or not the front door 93 is locked by the lock sensing sensor 104.

A solenoid (hereinafter, SL) 101 disposed on the locking unit 105 is turned ON/OFF in a state where the front door 93 is closed, and thus, a lock state and a free state of the front door 93 can be changed by rotating the locking member 103.

When the SL 101 is turned OFF, the engaging portion 103*a* of the locking member 103 is rotated and escapes into an upper side, and thus, the engagement with the hook member of the front door 93 is released, and the front door 93 is in the free state. At this time, the lock sensing sensor 104 is in a state where the lock sensing sensor 104 is not capable of sensing the sensing portion 103*b*, and senses that the front door 93 is not locked.

In contrast, when the SL 101 is turned ON, the engaging portion 103*a* of the locking member 103 is rotated and is lowered to a lower side, and thus, engages with the hook member 102 of the front door 93, and the front door 93 is in the lock state. At this time, the lock sensing sensor 104 is in a state where the lock sensing sensor 104 senses the sensing portion 103*b*, and senses that the front door 93 is locked.

<Control Unit>

Figure 6:
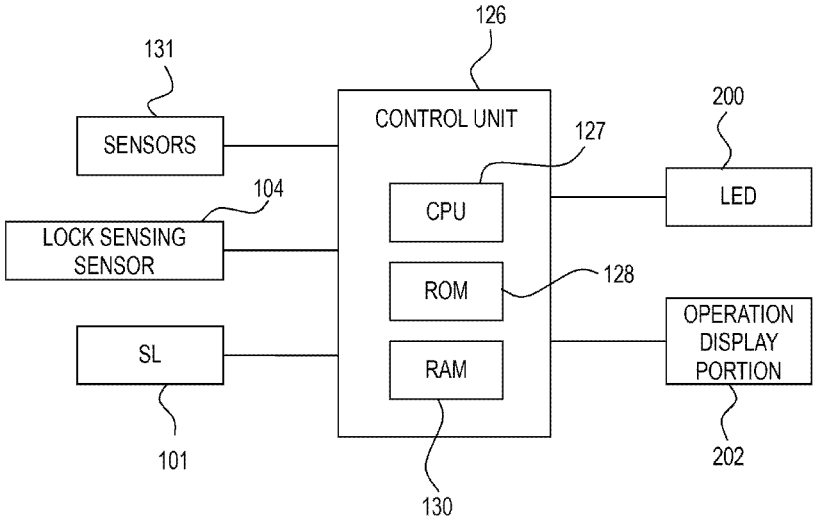
FIG. 6 is a block diagram of a control system.

In this embodiment, as illustrated in FIG. 6, a control unit 126 controlling the operation of the image forming apparatus including the SL 101 or the like is provided. A CPU 127 of the control unit 126 controls each portion of the image forming apparatus 1 by using a RAM 130 as a working area according to a program stored in a ROM 128. A signal from the sensor group 131 (sensors 401 to 408) detecting the sheet is input into the control unit 126. The operation display portion 202 is connected to the control unit 126. The CPU 127 controls the display of the operation display portion 202.

The CPU 127 confirms whether or not any one sensor of each of the sensors 401 to 408 senses the sheet, when a jam occurs. Accordingly, it is possible to confirm an accumulation position of the sheet when a jam occurs. The jam recovery procedure such as opening the right door 122 or the left door 123 is displayed on the operation display portion (another display portion) 202 based on an accumulation position of the sheet according to the signal of each of the sensors 401 to 408 when a jam occurs.

The lock sensing sensor 104 or the SL 101 is connected to the control unit 126. The SL 101 is controlled by the CPU 127 of the control unit 126 according to the signal from the lock sensing sensor 104. An LED 200 described below is connected to the control unit 126, and the control unit 126 performs control relevant to ON/OFF of the LED 200.

<Locking Operation>

Next, a locking operation of the front door 93 will be described. As described above, the sheet fed from the sheet container in order to form an image is discharged to the discharge stacking portion 50 through the sheet feeding portion 92 and the sheet conveying apparatus 91. At this time, there is a possibility that a jam (sheet clogging) occurs due to overlap feeding, non-feeding, or the like of the sheet.

In a case where the sheet conveying apparatus 91 is drawn when a jam occurs, there is a case where the sheet is broken according to the accumulation position of the sheet. Therefore, in a case where the sheet conveying apparatus 91 is drawn, and the sheet is broken, the front door 93 for drawing the sheet conveying apparatus 91 is locked not to be opened, and the effect thereof is required to be informed to the user.

For example, any one of the sensors 402, 404, and 406 detects the sheet, and then, the sheet is accumulated in a state of extending over both of the sheet feeding portion 92 and the sheet conveying apparatus 91.

In addition, for example, when the front end of the sheet reaches the discharge stacking portion 50, and the rear end is on the upstream in the sheet conveying direction from the inner discharge roller 46, that is, when the sheet is in a state of extending between the sheet conveying apparatus 91 and the reverse portion 58, in a case where the sheet conveying apparatus 91 is drawn, the sheet is broken.

In a case where the sheet is in the state of extending over the sheet conveying apparatus 91 and the sheet feeding portion 92 or the sheet conveying apparatus 91 and the reverse portion 58, and the sheet conveying apparatus 91 is drawn from the apparatus main body, the sheet is broken, and in the worst case, the apparatus is broken. Therefore, the front door 93 is locked such that the front door 93 is not opened, and thus, the sheet conveying apparatus 91 is not drawn. Then, the sheet is extracted from the sheet feeding portion 92 or the reverse portion 58 in a state where the front door 93 is locked, and thus, it is possible to reduce a damage on the sheet and a damage on the apparatus main body.

<Lock Display Portion>

Figure 1A:
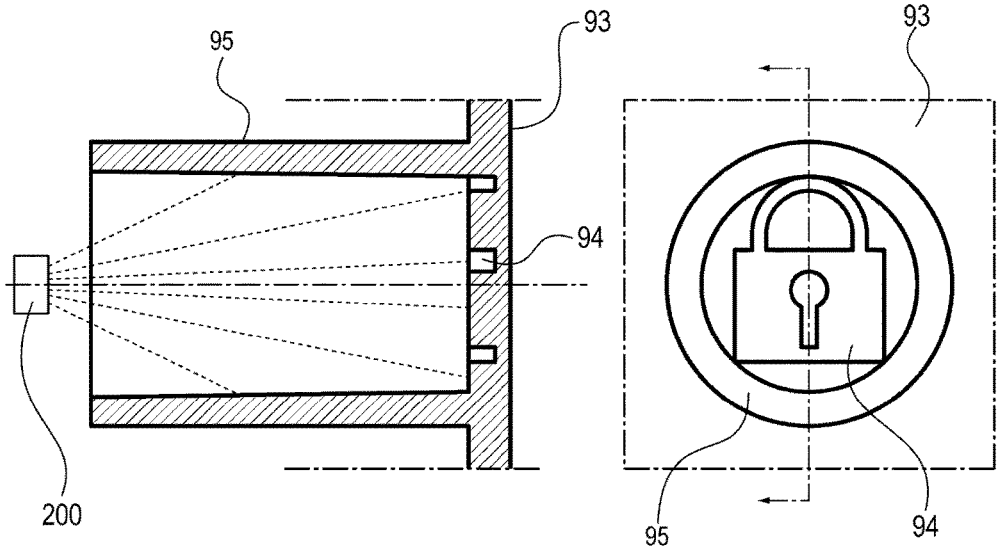
FIG. 1A is a sectional view of a lock display portion of a front door.
Figure 1B:
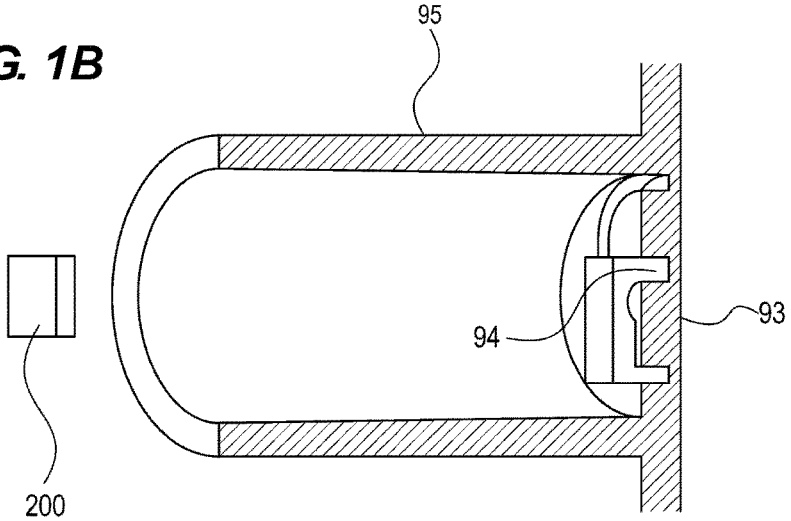
FIG. 1B is a perspective sectional view of the lock display portion of the front door.
Figure 5A:
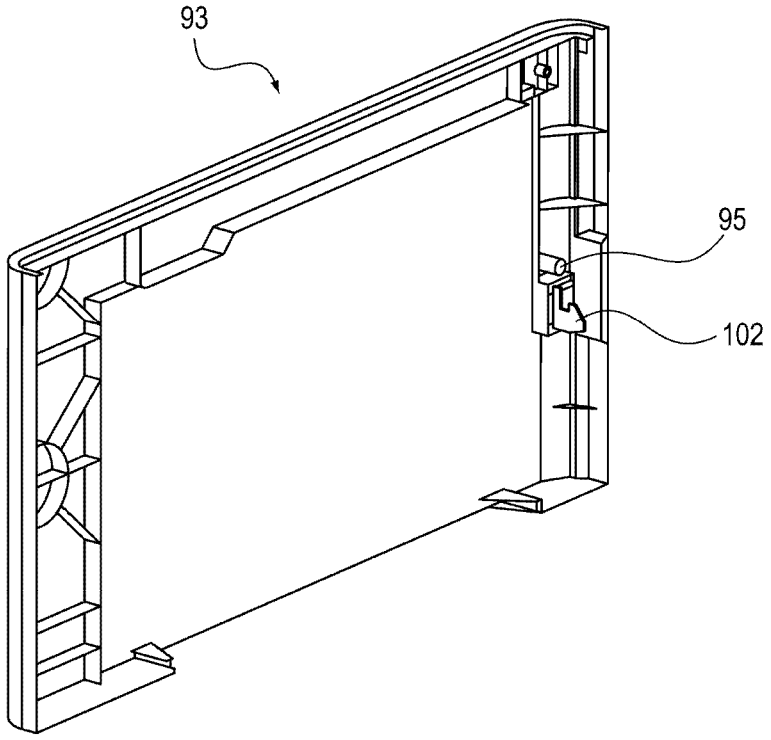
FIG. 5A is a perspective view illustrating the configuration of the front door.
Figure 5B:
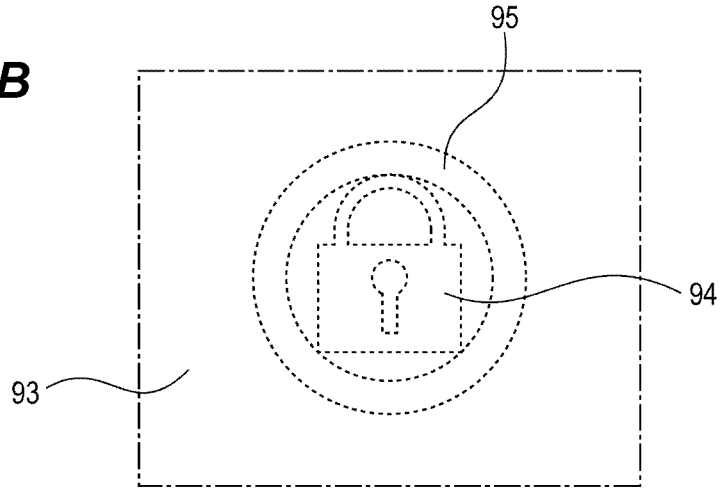
FIG. 5B is a diagram illustrating the shape of the lock display portion of the front door in the view from a front side.

Next, the display portion displaying the lock state will be described by using FIG. 1 and FIG. 5. FIG. 1 is a diagram illustrating a lock display 94, and illustrates the lock display 94 along with the LED 200. FIG. 1A is a sectional view of A-A of the lock display, and FIG. 1B is a sectional perspective view of the lock display. FIG. 5A is a perspective view of the front door 93 including the lock display 94. FIG. 5B is a plan view illustrating the lock display 94 in the view from the front side (the outside of the apparatus) of the front door 93.

As described above, in a case where it is concerned that the sheet conveying apparatus 91 is drawn from the apparatus main body, and the sheet is damaged, the front door 93 is in the lock state, and thus, it is not possible for the user to perform an opening operation of the front door 93. In order to inform the user of such a state of the apparatus (a state where the front door is not opened by being locked), the lock display 94 is disposed on the front door 93, and the LED 200 irradiating the lock display 94 with light is disposed on the apparatus main body side facing the lock display 94. The lock display 94 is disposed on the front door 93 as the exterior member, and is a display portion for displaying the lock state or the free state of the front door 93. The LED 200 is a light source for turning on the lock display 94. In addition, a light condensing portion 95 for efficiently condensing the light from the LED 200 on the lock display 94 is disposed between the lock display 94 and the LED 200 on the front door 93.

In the lighting of the LED 200, in a case where the SL 101 is turned ON and the lock sensing sensor 104 senses the sensing portion 103*b*, the LED 200 is turned on by a control unit (not illustrated). In contrast, in a case where the jam recovery is performed, and then, the SL 101 is turned OFF, and the lock sensing sensor 104 is not capable of sensing the sensing portion 103*b*, the LED 200 is turned off by the control unit.

Next, a detailed configuration of the lock display portion will be described by using FIG. 1 and FIG. 5. In this embodiment, the lock display 94 is designed as a key mark for representing the lock state of the front door 93. The lock display 94 is the same member as the front door 93, and is in the shape of a recess with respect to the other surface on an inner surface of the front door 93 (the surface of the front door 93 on a side opposite to the exterior surface side). That is, the lock display 94 is a thin portion, which is a part of the front door 93. The thin portion as the lock display 94 has a thickness thinner than the thickness of the front door 93, which is different from the thickness of the front door 93 (the thicknesses of other portions of the lock display 94 of the front door 93), and is formed in the shape of a key mark on the front door 93. More specifically, the thickness of the lock display 94 (the thin portion) is less than or equal to half the thickness of the front door 93. Then, the recessed shape of the lock display 94 is disposed only on the inside of the front door 93, which is not seen from the outside of the apparatus, and the exterior surface of the apparatus main body has a shape without a recess. The lock display 94 is molded to have a thickness (to be thin) less than or equal to half the thickness of the front door 93, and thus, in a case where the LED 200 irradiates the inside with light, the LED light is transmitted through only the thin portion, and thus, only the lock display 94 is seen in the view from the front surface of the apparatus main body. In addition, the lock display 94 has no recess on the exterior surface of the apparatus main body, and thus, when the LED 200 is turned off, designability is not degraded. Furthermore, the other portions of the lock display 94 of the front door 93, which have a thickness thicker than that of the lock display 94 (the thin portion), indicate portions other than the lock display 94 (the thin portion) in the region of the front door 93 which is irradiated with the LED light.

In this embodiment, the material of the front door 93 is PC+ABS, and a basic thickness for ensuring flame resistance is 2.0 mm. In contrast, the lock display 94 is the same member as the front door 93, and has a thickness thinner than that of the front door 93. In a case where the thickness of the portion of the lock display 94 is extremely thin, the LED light is easily transmitted through the lock display 94, but here, the thickness of the lock display 94 is set to 0.6 mm in consideration of moldability or the like.

In addition, the light condensing portion 95 is disposed between the lock display 94 and the LED 200. The light condensing portion 95 is a portion for efficiently condensing the LED light from the LED 200 on the lock display 94. The light condensing portion 95 is disposed to surround the lock display 94, and includes a cylindrical light condensing portion 95. The light condensing portion 95 is in the shape of a cylinder in which a central axis extends along a line connecting the LED 200 and the lock display 94. In order to more vividly light on the lock display 94 with a small LED light quantity (to allow the LED light to be transmitted through the lock display 94), it is necessary to condense light on the lock display 94 while reflecting the LED light on a front surface of the light condensing portion 95. For this reason, the light condensing portion 95 is formed in white with high reflectivity. Specifically, the surface of the light condensing portion 95, on which the LED light is reflected, can be in white rather than black such that more LED light is reflected. The light condensing portion 95 is in white, and thus, it is preferable that the front door 93 of the same member is also in white on the manufacturing, and for example, the colors of the front door 93 and the light condensing portion 95 may be different from each other according to bicolor mold or the like. In addition, in this embodiment, the light source of the LED 200 has an area of 3 mm square, and the light condensing portion 95 has a diameter of 12 mm.

As described above, the thin lock display 94 is disposed on the front door 93, and thus, when the LED 200 is turned off, it is possible for the key mark to be seen from the front surface of the main body only when the LED 200 is turned on while ensuring the designability. In addition, a part of the inside of the front door 93, which is the exterior member, is thinned as the lock display 94, and thus, only in a case where the lock display 94 is irradiated with the LED light, the lock display 94 functions as the display portion. Accordingly, the display portion is not required to be separately disposed on the exterior member, and when the LED is turned off, a configuration not degrading the designability can be obtained.

Furthermore, as illustrated in FIG. 3, a handle 201, which is operated by the user at the time of opening the front door 93, is disposed on an end portion of the front door 93 opposite to a hinge portion. Then, the lock display 94 is disposed in the vicinity of the handle 201. In addition, in FIG. 3, an operation display portion 202 is a portion in which the user inputs setting with respect to the image forming apparatus or a message for the user is displayed. When the front door 93 is locked, display is performed in which not only is the lock state informed by the lock display 94 of the front door 93 (the display portion), but also the operation display portion (the another display portion) is informed that the front door 93 is locked.

Furthermore, in the embodiment described above, the key mark is exemplified as the lock display 94. However, for example, it may be displayed that the front door 93 is locked by characters such as "being locked". In addition, in the embodiment described above, an aspect is exemplified in which when the front door 93 is locked, it is informed that the front door is locked by turning on the LED. However, when the front door 93 is not locked, it may be displayed that the front door 93 is in a lock releasing state (a state where the front door 93 can be opened) by turning on the LED.

<Operation when Jam Occurs>

Figure 7:
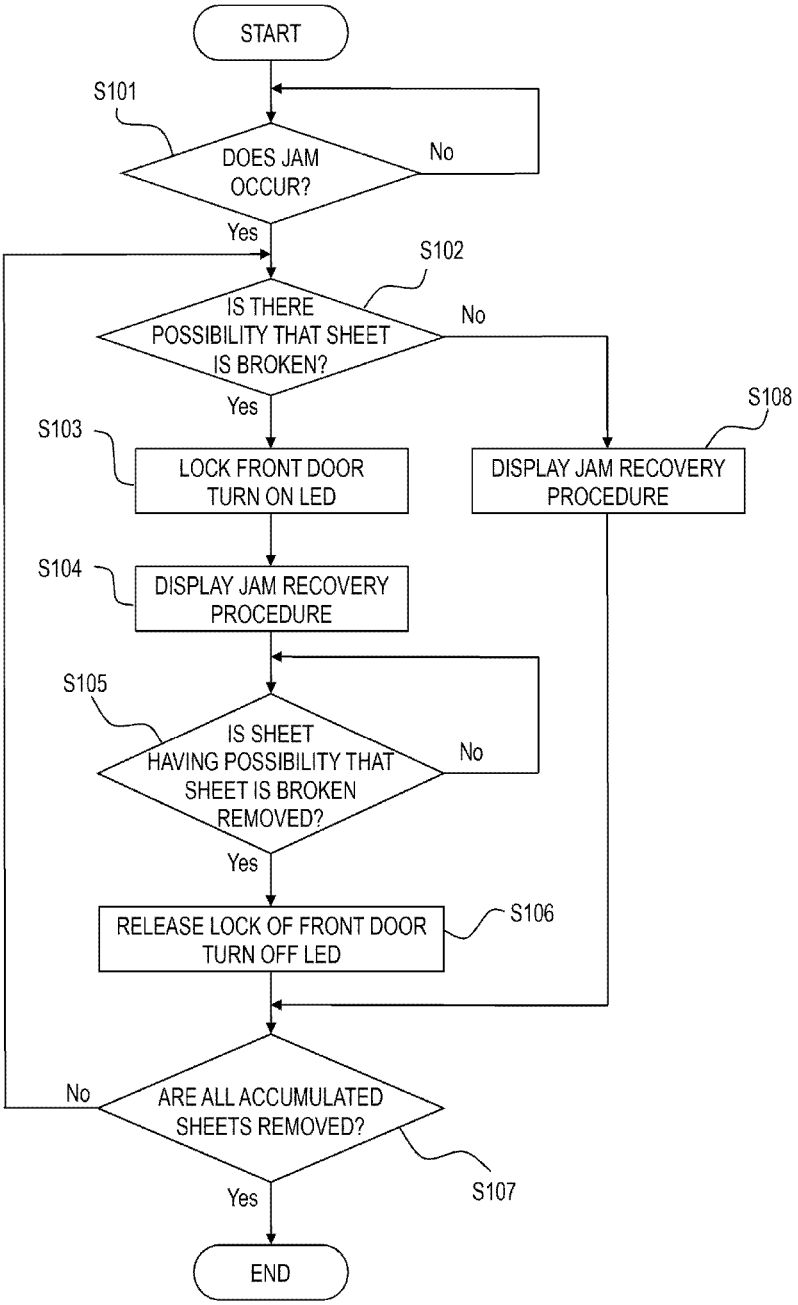
FIG. 7 is a flowchart illustrating an operation when a jam occurs.

An operation when a jam occurs will be described with reference to a flowchart of FIG. 7 or the like. In S101, the CPU 127 determines whether or not a jam occurs, based on the signal from the sensor group 131. In a case where it is determined that a jam occurs, the CPU 127 stops the operation relevant to the image formation and allows the process to proceed to S102. In a case where it is determined that the occurrence of a jam is not sensed, the determination is periodically repeated.

In S102, the CPU 127 determines whether or not there is a possibility that the sheet is broken when the sheet conveying apparatus 91 is drawn from the apparatus main body, based on the signal from the sensor group 131. In a case where the CPU 127 determines that there is a possibility that the sheet is broken, the CPU 127 allows the process to proceed to S103, and in a case where the CPU 127 determines that there is no possibility that the sheet is broken, the CPU 127 allows the process to proceed to S108.

Figure 8:
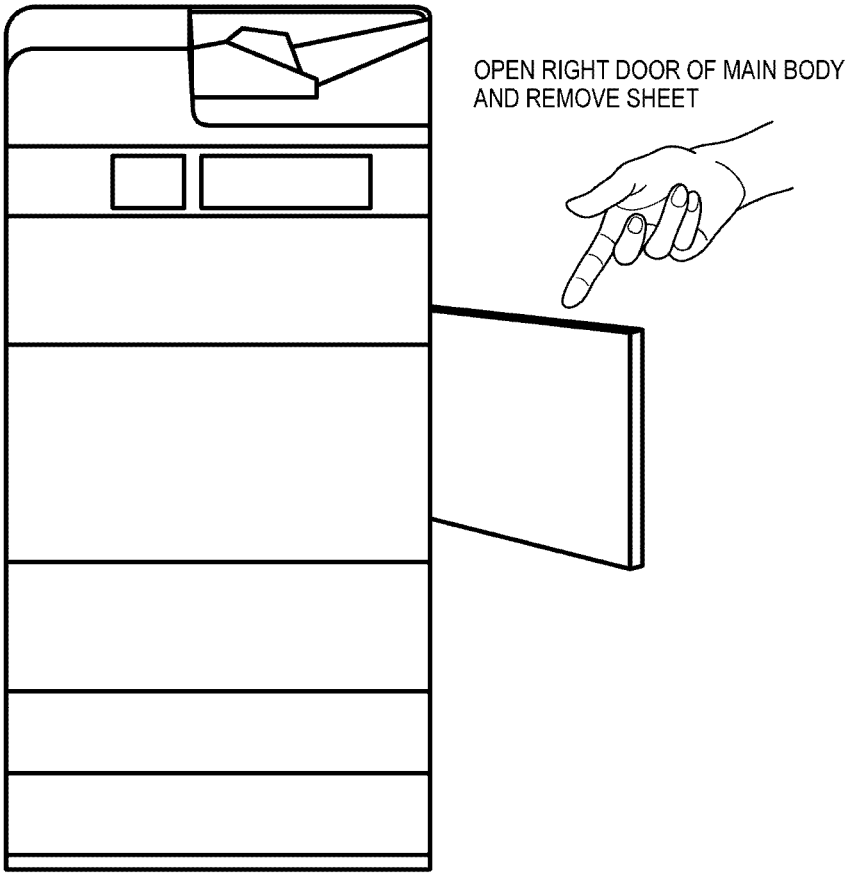
FIG. 8 is a diagram illustrating a screen of an operation panel.
Figure 9:
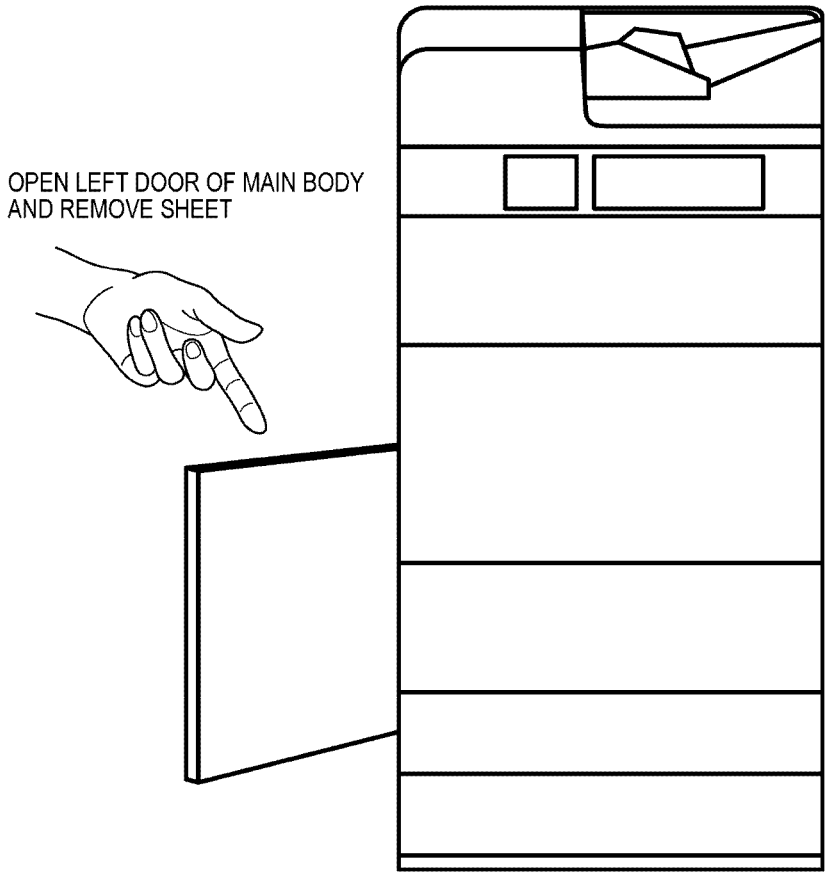
FIG. 9 is a diagram illustrating the screen of the operation panel.

In S103, the CPU 127 supplies power to the solenoid 101 of the locking unit 105, and locks the front door 93. In S103, the CPU 127 turns on the LED 200. The LED 200 is turned on, and thus, the lock display 94 displays that the front door 93 is locked. Subsequently, in S104, the CPU 127 allows the operation display portion 202 to display a screen representing the jam recovery procedure, here, a screen representing the position of the accumulated sheet or a jam releasing method. For example, a screen for urging the right door 122 as illustrated in FIG. 8 to be opened, and the accumulated sheet is removed, or the left door 123 as illustrated in FIG. 9 is opened, and the accumulated sheet is removed is displayed on the operation display portion 202. Which screen is displayed on the operation display portion 202 is determined by the CPU 127 based on the signal from the sensor group 131. Furthermore, the lock display 94 displays that the front door 93 is locked on the exterior surface of the front door 93, and the operation display portion 202 may display that the front door 93 is locked along with the jam recovery procedure.

In S105, the CPU 127 determines whether or not the sheet having a possibility that the sheet is broken is removed, based on the signal from the sensor group 131. In a case where it is determined as YES by the CPU 127 in the determination of S105, the CPU 127 allows the process to proceed to S106. In S106, the CPU 127 stops the supply of the power with respect to the solenoid 101 of the locking unit 105, releases the lock of the opening and closing of the front door 93, and turns off the LED 200.

Subsequently, the CPU 127 determines that there is no sheet accumulated in the image forming apparatus 1 in S107, based on the signal from the sensor group 131, and the operation when a jam occurs is ended. The CPU 127 determines that there is the sheet accumulated in the image forming apparatus 1 in S107, based on the signal from the sensor group 131, and allows the process to proceed to S102.

Figure 10:
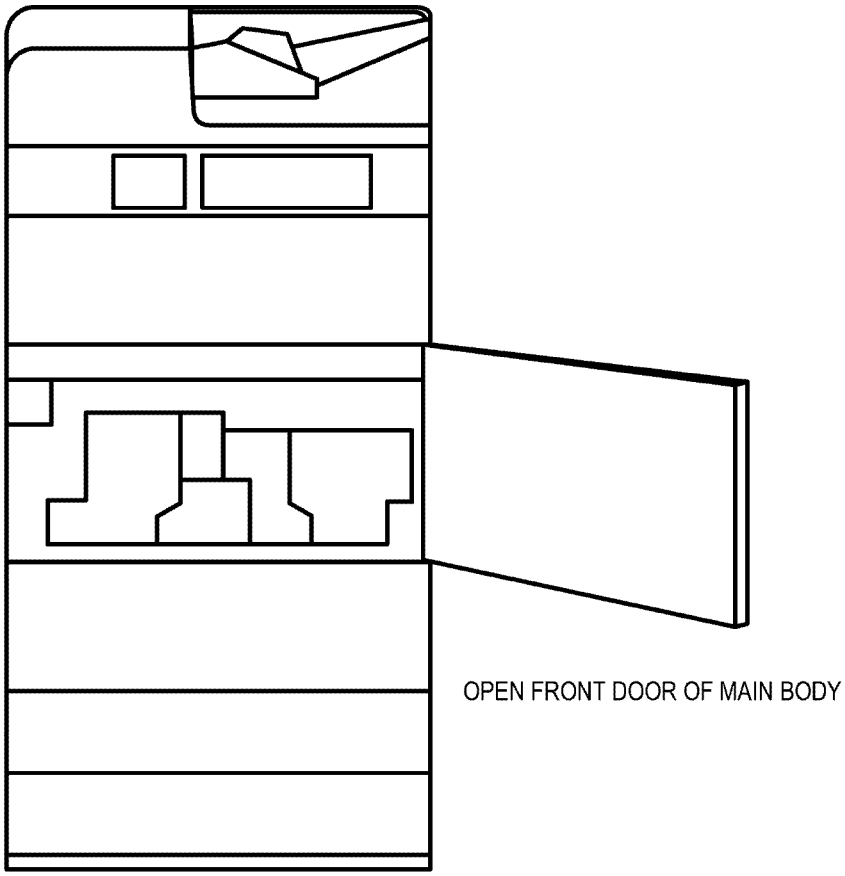
FIG. 10 is a diagram illustrating the screen of the operation panel.

In S102, in a case where the CPU 127 determines that there is no sheet having a possibility that the sheet is broken, in S108, the CPU 127 allows the operation display portion 202 to display a screen representing a procedure for removing the sheet. In S108, the screen to be displayed includes a screen for urging the front door 93 to be opened as illustrated in not only FIG. 8 and FIG. 9 but also FIG. 10. Which screen of the screens of FIG. 8, FIG. 9, and FIG. 10 is displayed is determined by the CPU 127 according to where the accumulated sheet is positioned. Where the accumulated sheet is positioned is determined by the CPU 127, based on the signal from the sensor group 131. Furthermore, the screen of FIG. 10 is displayed on the operation display portion 202 by the CPU 127, and the front door 93 is opened, and then, the sheet conveying apparatus 91 is drawn, and a screen representing that the sheet is removed from the drawn sheet conveying apparatus 91 is displayed on the operation display portion 202 by the CPU 127. That is, in a case where the process proceeds to S108, the opening and closing of the front door 93 is not required to be locked, and thus, the jam recovery procedure is displayed on the operation display portion 202 without turning on the LED 200.

In addition, in the embodiment described above, an aspect representing the lock state of the front door 93 is exemplified as an example of the display representing the state of the image forming apparatus. However, for example, "being printed" may be displayed during the operation of the image formation. In this case, the LED is turned on in order to display "being printed" during the operation of the image formation, and the LED is turned off during a standby period where the image forming operation is not performed.

Furthermore, in the embodiment described above, the image forming apparatus using four image forming portions having different colors is exemplified, but the number of image forming portions is not limited thereto, and as necessary, the number of image forming portions may be suitably set.

In addition, in the embodiment described above, a copying machine is exemplified as the image forming apparatus, but the invention is not limited thereto. For example, the image forming apparatus may be other image forming apparatuses such as a printer and a facsimile machine, or may be other image forming apparatuses such as a complex machine in which the functions of the printer and the facsimile machine are combined. In addition, the image forming apparatus is exemplified in which an intermediate transfer member is used, a toner image of each color is transferred onto the intermediate transfer member in a sequentially superimposed manner, the toner image borne on the intermediate transfer member is collectively transferred onto the sheet, but the invention is not limited thereto. An image forming apparatus may be used in which a sheet bearing member is used, and a toner image of each color is transferred onto a sheet borne on the sheet bearing member in a sequentially superimposed manner. In addition, an ink jet image forming unit may be used as the image forming unit. By applying the invention to such an image forming apparatus, it is possible to obtain the same effect.

An aspect is exemplified in which the sheet conveying apparatus 91, which is a conveying unit to be drawn, and the front door 93 (the exterior member) disposed on the sheet conveying apparatus 91 side in a drawing direction (the front side of the image forming apparatus 1) are each independently supported on the apparatus main body to be movable. However, the exterior member including the display portion for displaying that the front door 93 is locked may be fixedly attached to the sheet conveying apparatus 91, and the exterior member may be drawn from the apparatus main body by being integrated with the sheet conveying apparatus 91. In this case, in a case where the sheet conveying apparatus 91 is drawn, and there is a possibility that the sheet is broken, the sheet conveying apparatus 91 may be locked by the locking unit such that the sheet conveying apparatus 91 is not drawn. The exterior member is attached to the sheet conveying apparatus 91, and thus, in a case where the sheet conveying apparatus 91 is locked by the locking unit such that the sheet conveying apparatus 91 is not drawn, the exterior member is also locked by the locking unit not to be moved.

In addition, in the embodiment described above, an aspect is exemplified in which the front door 93 is locked by the locking unit 105 only when a jam occurs. However, for example, the front door 93 may be constantly locked by the locking unit 105 during the operation of the image formation. When the front door 93 is locked by the locking unit 105, the LED 200 is turned on in order to display that the front door 93 is locked on the lock display 94. Even when a jam occurs, the front door 93 is continuously locked by the locking unit 105. Then, only in a case where the sheet conveying apparatus 91 is required to be drawn in order for jam recovery, the lock of the front door 93 by the locking unit 105 is released, and the LED 200 is turned off.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-136078, filed Jul. 8, 2016, which is hereby incorporated by reference herein in its entirety.

What is claimed is:

1. An image forming apparatus forming an image on a sheet, the apparatus comprising:

an exterior member configured to open and close with respect to an apparatus main body;

a locking portion configured to lock the exterior member to the apparatus main body such that the exterior member is not moved with respect to the apparatus main body; and a light source configured to emit light;

wherein the exterior member includes a thin portion which is made of the same material as other portions of the exterior member and is thinner than thicknesses of the other portions of the exterior member, and which allows penetration of the light from the light source so that the exterior member displays a status of the locking portion by the light penetrating at the thin portion.

2. The image forming apparatus according to claim 1, further comprising:

a light condensing portion disposed between the thin portion and the light source and configured to collect the light from the light source.

3. The image forming apparatus according to claim 2, wherein the light condensing portion is formed in white.

4. The image forming apparatus according to claim 2, wherein the light condensing portion is disposed on the exterior member to surround the thin portion.

5. The image forming apparatus according to claim 2, wherein the light source is disposed on the apparatus main body, and the light condensing portion is disposed on the exterior member.

6. The image forming apparatus according to claim 1, wherein the light source is turned on when the exterior member is locked by the locking portion.

7. An image forming apparatus comprising:

a conveying unit including a first conveying path on which a sheet is conveyed and drawable in a drawing direction with respect to the apparatus main body, an exterior member configured to open with respect to an apparatus main body so that the conveying unit can be drawn in the drawing direction;

a locking portion which is configured to lock the exterior member to the apparatus main body such that the exterior member is not moved with respect to the apparatus main body;

a light source configured to emit light;

a display portion disposed on the exterior member and displaying a state of the locking portion by penetrating the light from the light source;

a door movably supported on the apparatus main body in which a second conveying path on which the sheet is conveyed is configured to be opened by moving the door with respect to the apparatus main body;

another display portion configured to display a jam recovery procedure; and a control unit which allows the another display portion to display that the door is urged to be opened while allowing the display portion to display that the exterior member is locked when a jam occurs.

8. The image forming apparatus according to claim 7, wherein in a case where the control unit determines that the sheet is accumulated in a state of extending over the conveying unit and the apparatus main body when a jam occurs, the control unit locks the exterior member to the locking portion and allows the display portion to display that the exterior member is locked, and in a case where the control unit determines that there is no sheet which is accumulated in a state of extending over the conveying unit and the apparatus main body and the sheet is accumulated in the conveying unit when a jam occurs, the control unit does not lock the exterior member to the locking portion, and does not allow the display portion to display that the exterior member is locked.

9. The image forming apparatus according to claim 8, wherein in a case where the control unit determines that there is no sheet accumulated in a state of extending over the conveying unit and the apparatus main body when a jam occurs, the control unit performs display of urging the exterior member to be moved to the another display portion in order to remove the sheet on the first conveying path of the conveying unit.

10. The image forming apparatus according to claim 7, wherein the exterior member is rotatably supported on the apparatus main body.

11. The image forming apparatus according to claim 1, further comprising:

another display portion configured to display a jam recovery procedure; and a control unit which can allow the another display portion to display the jam recovery procedure while allowing the display portion to display that the exterior member is locked.

12. The image forming apparatus according to claim 11, wherein in a case where the exterior member is locked to the locking portion when a jam occurs, the control unit allows the display portion to display that the exterior member is locked and allows the another display portion to display the jam recovery procedure, and in a case where the exterior member is not locked to the locking portion when a jam occurs, the control unit does not allow the display portion to display that the exterior member is locked and allows the another display portion to display the jam recovery procedure.

13. The image forming apparatus according to claim 12, further comprising:

a conveying unit including a conveying path on which a sheet is conveyed and drawable in a drawing direction with respect to the apparatus main body, in which the exterior member is disposed on the conveying unit side in the drawing direction, wherein in a case where the control unit determines that there is no sheet accumulated in a state of extending over the conveying unit and the apparatus main body when a jam occurs, the control unit allows the another display portion to display that the exterior member is urged to be moved in order to remove the sheet on the conveying path of the conveying unit.

14. The image forming apparatus according to claim 11, further comprising:

a light condensing portion disposed between the thin portion and the light source and configured to condense the light from the light source.

15. The image forming apparatus according to claim 2, wherein the exterior member is disposed on the apparatus main body to be opened and closed, and the light source is disposed on the apparatus main body, and the light condensing portion is disposed on the exterior member.

16. The image forming apparatus according to claim 2, wherein the light condensing portion is in the shape of a cylinder of which a central axis extends along a line connecting the light source and the thin portion.

17. The image forming apparatus according to claim 1, wherein the thin portion has a thickness less than or equal to half the thicknesses of the other portion of the exterior member.

18. The image forming apparatus according to claim 1, wherein the thin portion is disposed on an inner surface of the exterior member in the shape of a recess.

19. The image forming apparatus according to claim 7, wherein the display portion has a thin portion which is a part of the exterior member of the display portion and thinner than other portions of the exterior member so as to allow penetration of the light from the light source.

20. The image forming apparatus according to claim 7, wherein the exterior member is disposed on the conveying unit and the exterior member moves with the conveying unit.

21. The image forming apparatus according to claim 1, wherein the exterior member is a one-piece member comprising the thin portion and the other portions of the exterior member.

22. The image forming apparatus according to claim 1, wherein an outer surface of the exterior member is continuously flat between the thin portion and the other portions.

23. The image forming apparatus according to claim 1, wherein the other portions of the exterior member are adjacent to the thin portion and the other portions are configured to receive the light from the light source but the light does not penetrate the other portions of the exterior member.

* * * * *